US008298619B2

(12) United States Patent
Goodwin et al.

(10) Patent No.: US 8,298,619 B2
(45) Date of Patent: Oct. 30, 2012

(54) METHOD AND APPARATUS FOR APPLYING A TOPCOAT TO A GOLF BALL SURFACE

(75) Inventors: David A. Goodwin, Portland, OR (US); Derek A. Fitchett, Portland, OR (US)

(73) Assignee: Nike, Inc., Beaverton, OR (US)

( * ) Notice: Subject to any disclaimer, the term of this patent is extended or adjusted under 35 U.S.C. 154(b) by 368 days.

(21) Appl. No.: 12/470,820

(22) Filed: May 22, 2009

(65) Prior Publication Data

US 2010/0298069 A1 Nov. 25, 2010

(51) Int. Cl.
*B05D 1/02* (2006.01)

(52) U.S. Cl. ..... 427/421.1; 427/427.4; 118/300; 118/323; 473/378

(58) Field of Classification Search ..... 427/421.1, 427/180, 189; 473/358, 378
See application file for complete search history.

(56) References Cited

U.S. PATENT DOCUMENTS

| | | | | |
|---|---|---|---|---|
| 5,009,367 | A | 4/1991 | Nielsen | |
| 5,047,723 | A * | 9/1991 | Puumalainen | 324/464 |
| 5,106,650 | A | 4/1992 | Hoy et al. | |
| 5,211,342 | A | 5/1993 | Hoy et al. | |
| 5,290,602 | A | 3/1994 | Argyropoulos et al. | |
| 5,290,603 | A | 3/1994 | Nielsen et al. | |
| 5,290,604 | A | 3/1994 | Nielsen | |
| 5,362,519 | A | 11/1994 | Argyropoulos et al. | |
| 5,851,158 | A | 12/1998 | Winrow et al. | |
| 6,120,393 | A | 9/2000 | Sullivan et al. | |
| 6,146,288 | A | 11/2000 | Crast et al. | |
| 6,193,618 | B1 | 2/2001 | Sullivan et al. | |
| 6,221,435 | B1 | 4/2001 | Nielsen | |
| 6,244,977 | B1 | 6/2001 | Sullivan et al. | |
| 6,299,550 | B1 * | 10/2001 | Molitor et al. | 473/354 |
| 6,319,563 | B1 | 11/2001 | Skrabski et al. | |
| 6,435,985 | B1 | 8/2002 | Sullivan et al. | |
| 6,561,927 | B1 | 5/2003 | Sullivan et al. | |
| 6,602,151 | B1 * | 8/2003 | Maruoka et al. | 473/377 |
| 6,821,315 | B2 | 11/2004 | Milli | |
| 7,166,043 | B2 | 1/2007 | Ohira | |
| 2003/0104880 | A1 * | 6/2003 | Fushihara | 473/378 |
| 2003/0172807 | A1 * | 9/2003 | Milli | 95/45 |

(Continued)

FOREIGN PATENT DOCUMENTS

| | | | |
|---|---|---|---|
| EP | 1332784 | A1 | 8/2003 |
| JP | 2004016677 | A | 1/2004 |

OTHER PUBLICATIONS

International Search Report mailed Aug. 3, 2010 for PCT/US2010/030974.

(Continued)

*Primary Examiner* — Kelly M Gambetta
*Assistant Examiner* — Nathan T Leong
(74) *Attorney, Agent, or Firm* — Banner & Witcoff, Ltd.

(57) ABSTRACT

A topcoat is applied to a surface of a golf ball using a carrier fluid comprising nitrogen gas or nitrogen-enriched air. The carrier fluid typically has air enriched to about 90-99.5% nitrogen. A mixture of carrier fluid and coating material may be sprayed onto the exterior of the golf ball. Nitrogen-enriched air delivery provides a number of benefits over compressed air delivery, such as reduced coating thickness, reduced variance in the coating thickness and average thickness, reduced pooling in dimple center, edge ratio closer to 1.0, faster cure times, reduced viscosity, less material usage, reduced material flow rate, reduced atomization air pressure, and decreased drying time.

14 Claims, 8 Drawing Sheets

U.S. PATENT DOCUMENTS

| | | | | |
|---|---|---|---|---|
| 2004/0043837 | A1 | 3/2004 | Sullivan et al. | |
| 2004/0222555 | A1 | 11/2004 | Puniello et al. | |
| 2008/0075875 | A1* | 3/2008 | Milli | 427/422 |
| 2008/0128530 | A1 | 6/2008 | Milli | |
| 2008/0248898 | A1 | 10/2008 | Morgan et al. | |

OTHER PUBLICATIONS

Stucchi, Francesco, "Coating profiles with the aid of nitrogen at CFZ Painting," (Coating with Nitrogen, <http://www.eurosider.com/gfx/schedetecniche/CFZ%20Friuli%20Intagli%20ENG.pdf>), 26

Vemicatura del Legno 152 (2007), pp. 55-58.

Mohanty, D. Kosikowski, and J. Stanisic, "The Hybrid Spray System," <http://www.asminternational.org/CommunityImages/TSS/iTSSe/Aug2006.pdf>, Advanced Materials & Processes, Aug. 2006, vol. 1, Issue 2, pp. 51-78.

* cited by examiner

METHOD AND APPARATUS FOR APPLYING A TOPCOAT TO A GOLF BALL SURFACE

BACKGROUND

Golf balls generally comprise either a one-piece construction or several layers including an outer cover surrounding a core. Typically, one or more layers of paint and/or clear coat are applied to the outer surface of the golf ball. For example, in one typical design, the outer surface of the golf ball is first painted with at least one clear or pigmented basecoat primer followed by at least one application of a clear topcoat. The clear topcoat may serve a variety of functions, such as protecting the cover material, improving aerodynamics of ball flight, preventing yellowing, and/or improving aesthetics of the ball.

One common topcoat utilizes a solvent borne two-component polyurethane, which is applied to the exterior of a golf ball. This topcoat formulation generally requires the use of a solvent that is a significant source of volatile organic compounds (VOC), which pose environmental and health concerns. Another type of coating, ultraviolet (UV) curable coatings, generally do not require solvents.

Compressed air is normally used to deliver and spray the coating materials. These techniques are prone to produce non-uniform and/or unduly thick coatings, and also fill in the dimples, which may adversely impact aerodynamic (flight) characteristics of the golf ball. In the case of UV coatings, oxygen present in air may interfere with the transmission of UV energy to the reactants, and also is prone to react with the reactants, especially the photoinitiator, thus requiring that excess quantities of reactants be used.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention are directed to methods for applying a topcoat or other coating to a surface of a golf ball. One aspect is directed to a method of applying a coating to an exterior surface of a golf ball. A carrier fluid comprising nitrogen gas or nitrogen-enriched air is combined with a coating material to form a mixture. The mixture is then sprayed onto the exterior of the golf ball.

The carrier fluid, which typically comprises nitrogen gas or air enriched to about 90-99.5% nitrogen, provides reduced application time and increased transfer efficiency relative to compressed air delivery systems. The process also avoids the need for long dry times for water-borne materials. The process further provides for reduced material usage, increased flash times, removal of static electricity, changed polarity to promote paint attraction to the ball surface, reduced overspray, reduced filter usage, removal of surface moisture and solid impurities, elimination of variability of density in air, elimination of solvent pop (e.g., tiny holes formed as a result of solvent being trapped beneath coating), and reduced VOC emissions. Other benefits over compressed air delivery based systems and methods include reduced coating thickness, reduced variance in the coating thickness and average thickness, reduced pooling in dimple center, edge ratio closer to the ideal value of 1.0, faster cure times, reduced viscosity, less material usage, reduced material flow rate, reduced atomization air pressure, and decreased drying time.

BRIEF DESCRIPTION OF THE DRAWINGS

A more complete understanding of the present invention and certain advantages thereof may be acquired by referring to the following detailed description in consideration with the accompanying drawings, in which:

FIG. 3 shows a uniform thicknesses and FIG. 3A shows pooling in the dimple bottom that may occur when using conventional coating methods.

DETAILED DESCRIPTION

Figure 1:
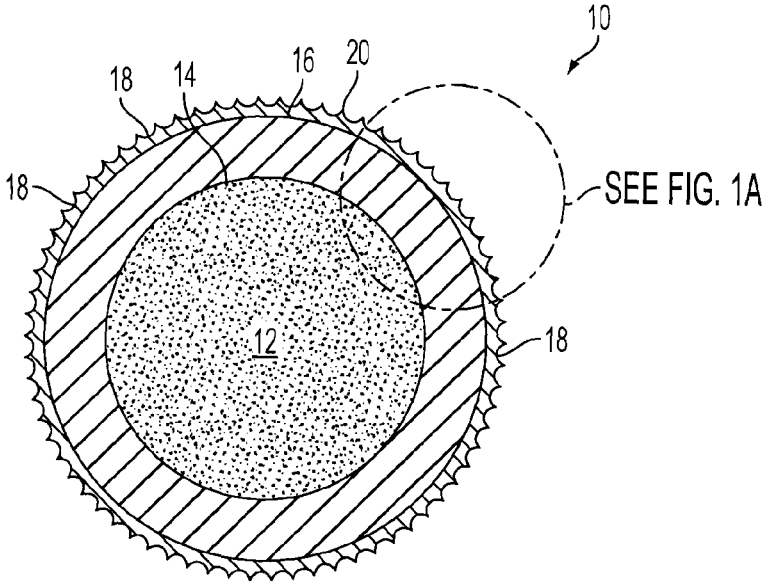
FIGS. 1 and 1A schematically illustrate a cross-sectional view of a golf ball having a coating thereon.

In the following description of various example structures, reference is made to the accompanying drawings, which form a part hereof, and in which are shown by way of illustration various example golf ball structures. Additionally, it is to be understood that other specific arrangements of parts and structures may be utilized and structural and functional modifications may be made without departing from the scope of the present invention. Also, while terms such as "top," "bottom," "front," "back," "rear," "side," "underside," "overhead," and the like may be used in this specification to describe various example features and elements of the invention, these terms are used herein as a matter of convenience, e.g. based on the example orientations shown in the figures and/or the orientations in typical use. Nothing in this specification should be construed as requiring a specific three dimensional or spatial orientation of structures.

A. General Description of Golf Balls and Manufacturing Systems and Methods

Golf balls may be of varied construction, e.g., one-piece balls, two-piece balls, three-piece balls (including wound balls), four-piece balls, etc. The difference in play characteristics resulting from these different types of constructions can be quite significant. Generally, golf balls may be classified as solid or wound balls. Solid balls that have a two-piece construction, typically an cross-linked rubber core, e.g., polybutadiene cross-linked with zinc diacrylate and/or similar cross-linking agents, encased by a blended cover, e.g., ionomer resins, are popular with many average recreational golfers. The combination of the core and cover materials provide a relatively "hard" ball that is virtually indestructible by golfers and one that imparts a high initial velocity to the ball, resulting in improved distance. Because the materials of which the ball is formed are very rigid, two-piece balls tend to have a hard "feel" when struck with a club. Likewise, due to their hardness, these balls have a relatively low spin rate, which also helps provide greater distance.

Wound balls are generally constructed from a liquid or solid center surrounded by tensioned elastomeric material and covered with a durable cover material, e.g., ionomer resin, or a softer cover material, e.g., balata or polyurethane. Wound balls are generally thought of as performance golf balls and have good resiliency, desirable spin characteristics, and feel when struck by a golf club. However, wound balls are generally difficult to manufacture as compared to solid golf balls.

More recently, three- and four-piece balls have gained popularity, both as balls for average recreational golfers as well as performance balls for professional and other elite level players.

A variety of golf balls have been designed to provide particular playing characteristics. These characteristics generally include the initial velocity and spin of the golf ball, which can be optimized for various types of players. For instance, certain players prefer a ball that has a high spin rate in order to control and stop the golf ball around the greens. Other players prefer a ball that has a low spin rate and high resiliency to maximize distance. Generally, a golf ball having a hard core and a soft cover will have a high spin rate. Conversely, a golf ball having a hard cover and a soft core will have a low spin rate. Golf balls having a hard core and a hard cover generally have very high resiliency for distance, but are hard feeling and difficult to control around the greens.

The carry distance of some conventional two-piece balls has been improved by altering the typical single layer core and single cover layer construction to provide a multi-layer ball, e.g., a dual cover layer, dual core layer, and/or a ball having an intermediate layer disposed between the cover and the core. Three- and four-piece balls are now commonly found and commercially available. Aspects of this invention may be applied to all types of constructions, including the various wound, solid, and/or multi-layer ball constructions described above.

Figure 1A:
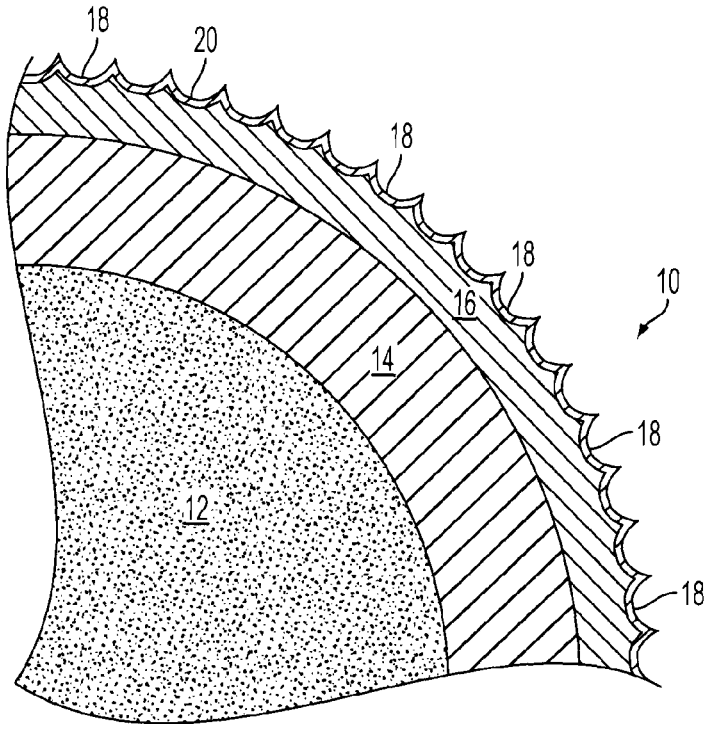

FIGS. 1 and 1A show an example of a golf ball 10, which has a core 12, an intermediate layer 14, a cover 16 having a plurality of dimples 18, and a topcoat 20 applied over the exterior surface of the golf ball 10. The golf ball 10 alternatively may be only one piece such that the core 12 represents the entirety of the golf ball 10, and the plurality of dimples are formed on the core 12. The ball 10 also may have any other construction, including the various example constructions described herein. The thickness of the topcoat 20 typically is significantly less than that of the cover 16 or the boundary layer 14, and by way of example may range from about 5 to about 25 μm. The topcoat 20 should have a minimal effect on the depth and volume of the dimples 18.

The cover 16 of the golf ball 10 may be made of any number of materials such as ionomeric, thermoplastic, elastomeric, urethane, balata (natural or synthetic), polybutadiene, or combinations thereof. An optional primer or basecoat may be applied to the exterior surface of the cover 16 of the golf ball 10 prior to application of the coating layer.

The Center

A golf ball may be formed, for example, with a center having a low compression, but still exhibit a finished ball COR and initial velocity approaching that of conventional two-piece distance balls. The center may have, for example, a compression of about 60 or less. The finished balls made with such centers have a COR, measured at an inbound speed of 125 ft./s., of about 0.795 to about 0.815. "COR" refers to Coefficient of Restitution, which is obtained by dividing a ball's rebound velocity by its initial (i.e., incoming) velocity. This test is performed by firing the samples out of an air cannon at a vertical steel plate over a range of test velocities (e.g., from 75 to 150 ft/s). A golf ball having a high COR dissipates a smaller fraction of its total energy when colliding with the plate and rebounding therefrom than does a ball with a lower COR.

The terms "points" and "compression points" refer to the compression scale or the compression scale based on the ATTI Engineering Compression Tester. This scale, which is well known to persons skilled in the art, is used in determining the relative compression of a center or ball.

The center may have, for example, a Shore C hardness of about 65 to about 80. The center may have a diameter of about 1.25 inches to about 1.5 inches. The base composition for forming the center may include, for example, polybutadiene and about 20 to 50 parts of a metal salt diacrylate, dimethacrylate, or monomethacrylate. If desired, the polybutadiene can also be mixed with other elastomers known in the art, such as natural rubber, styrene butadiene, and/or isoprene, in order to further modify the properties of the center. When a mixture of elastomers is used, the amounts of other constituents in the center composition are usually based on 100 parts by weight of the total elastomer mixture.

Metal salt diacrylates, dimethacrylates, and monomethacrylates include without limitation those wherein the metal is magnesium, calcium, zinc, aluminum, sodium, lithium or nickel. Zinc diacrylate, for example, provides golf balls with a high initial velocity in the United States Golf Association ("USGA") test.

Free radical initiators often are used to promote cross-linking of the metal salt diacrylate, dimethacrylate, or monomethacrylate and the polybutadiene. Suitable free radical initiators include, but are not limited to peroxide compounds, such as dicumyl peroxide; 1,1-di(t-butylperoxy) 3,3,5-trimethyl cyclohexane; bis(t-butylperoxy) diisopropylbenzene; 2,5-dimethyl-2,5 di(t-butylperoxy) hexane; or di-t-butyl peroxide; and mixtures thereof. The initiator(s) at 100 percent activity may be added in an amount ranging from about 0.05 to about 2.5 pph based upon 100 parts of butadiene, or butadiene mixed with one or more other elastomers. Often the amount of initiator added ranges from about 0.15 to about 2 pph, and more often from about 0.25 to about 1.5 pph. The golf ball centers may incorporate 5 to 50 pph of zinc oxide (ZnO) in a zinc diacrylate-peroxide cure system that cross-links polybutadiene during the core molding process.

The center compositions may also include fillers, added to the elastomeric composition to adjust the density and/or specific gravity of the center. Non-limiting examples of fillers include zinc oxide, barium sulfate, and regrind, e.g., recycled core molding matrix ground to about 30 mesh particle size. The amount and type of filler utilized is governed by the amount and weight of other ingredients in the composition, bearing in mind a maximum golf ball weight of 1.620 oz has been established by the USGA. Fillers usually range in specific gravity from about 2.0 to about 5.6. The amount of filler in the center may be lower such that the specific gravity of the center is decreased.

The specific gravity of the center may range, for example, from about 0.9 to about 1.3, depending upon such factors as the size of the center, cover, intermediate layer and finished ball, as well as the specific gravity of the cover and intermediate layer.

Other components such as accelerators, e.g., tetra methylthiuram, processing aids, processing oils, plasticizers, dyes and pigments, antioxidants, as well as other additives well known to the skilled artisan may also be used in amounts sufficient to achieve the purpose for which they are typically used.

Intermediate Layer(s)

The golf ball also may have one or more intermediate layers formed, for example, from dynamically vulcanized thermoplastic elastomers, functionalized styrene-butadiene elastomers, thermoplastic rubbers, thermoset elastomers, thermoplastic urethanes, metallocene polymers, thermoset urethanes, ionomer resins, or blends thereof For example, an intermediate layer may include a thermoplastic or thermoset polyurethane. Non-limiting of commercially available dynamically vulcanized thermoplastic elastomers include SANTOPRENE®, SARLINK®, VYRAM®, DYTRON®, and VISTAFLEX®. SANTOPRENE® is a dynamically vulcanized PP/EPDM. Examples of functionalized styrene-butadiene elastomers, i.e., styrene-butadiene elastomers with functional groups such as maleic anhydride or sulfonic acid, include KRATON FG-1901x and FG-1921x, which are available from the Shell Corporation of Houston, Tex.

Examples of suitable thermoplastic polyurethanes include ESTANE® 58133, ESTANE® 58134 and ESTANE® 58144, which are commercially available from the B. F. Goodrich Company of Cleveland, Ohio.

Examples of metallocene polymers, i.e., polymers formed with a metallocene catalyst, include those commercially available from Sentinel Products of Hyannis, Mass. Suitable thermoplastic polyesters include polybutylene terephthalate. Thermoplastic ionomer resins may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, low modulus ionomers such as acid-containing ethylene copolymer ionomers, include E/X/Y copolymers where E is ethylene, X is a softening comonomer such as acrylate or methacrylate. Non-limiting examples of ionomer resins include SURLYN® and LOTEK®, which are commercially available from DuPont and Exxon, respectively.

Alternatively, the intermediate layer may be a blend of a first and a second component wherein the first component is a dynamically vulcanized thermoplastic elastomer, a functionalized styrene-butadiene elastomer, a thermoplastic or thermoset polyurethane or a metallocene polymer and the second component is a material such as a thermoplastic or thermoset polyurethane, a thermoplastic polyetherester or polyetheramide, a thermoplastic ionomer resin, a thermoplastic polyester, another dynamically vulcanized elastomer, another a functionalized styrene-butadiene elastomer, another a metallocene polymer or blends thereof. At least one of the first and second components may include a thermoplastic or thermoset polyurethane.

An intermediate layer also may be formed from a blend containing an ethylene methacrylic/acrylic acid copolymer. Non-limiting examples of acid-containing ethylene copolymers include ethylene/acrylic acid; ethylene/methacrylic acid; ethylene/acrylic acid/n- or isobutyl acrylate; ethylene/methacrylic acid/n- or iso-butyl acrylate; ethylene/acrylic acid/methyl acrylate; ethylene/methacrylic acid/methyl acrylate; ethylene/acrylic acid/iso-bornyl acrylate or methacrylate and ethylene/methacrylic acid/isobornyl acrylate or methacrylate. Examples of commercially available ethylene methacrylic/acrylic acid copolymers include NUCREL® polymers, available from DuPont.

Alternatively, an intermediate layer may be formed from a blend which includes an ethylene methacrylic/acrylic acid copolymer and a second component which includes a thermoplastic material. Suitable thermoplastic materials for use in the intermediate blend include, but are not limited to, polyesterester block copolymers, polyetherester block copolymers, polyetheramide block copolymers, ionomer resins, dynamically vulcanized thermoplastic elastomers, styrene-butadiene elastomers with functional groups such as maleic anhydride or sulfonic acid attached, thermoplastic polyurethanes, thermoplastic polyesters, metallocene polymers, and/or blends thereof.

The intermediate layer often has a specific gravity of about 0.8 or more. In some examples the intermediate layer has a specific gravity greater than 1.0, e.g., ranging from about 1.2 to about 1.3. Specific gravity of the intermediate layer may be adjusted, for example, by adding a filler such as barium sulfate, zinc oxide, titanium dioxide and combinations thereof.

The intermediate layer blend may have a flexural modulus of less than about 10,000 psi, often from about 5,000 to about 8,000 psi. The intermediate layers often have a Shore D hardness of about 35 to 50. The intermediate layer and core construction together may have a compression of less than about 65, often from about 50 to about 65. Usually, the intermediate layer has a thickness from about 0.020 inches to about 0.125 inches.

The golf balls may include a single intermediate layer or a plurality of intermediate layers. In the case where a ball includes a plurality of intermediate layers, a first intermediate layer may include, for example, a thermoplastic material having a hardness greater than that of the core. A second intermediate layer may be disposed around the first intermediate layer and may have a greater hardness than that of the first intermediate layer. The second intermediate layer may be formed of materials such as polyether or polyester thermoplastic urethanes, thermoset urethanes, and ionomers such as acid-containing ethylene copolymer ionomers.

In addition, a third intermediate layer may be disposed in between the first and second intermediate layers. The third intermediate layer may be formed of the variety of materials as discussed above. For example, the third intermediate layer may have a hardness greater than that of the first intermediate layer.

The Cover Layer

A golf ball also typically has a cover layer that includes one or more layers of a thermoplastic or thermosetting material. A variety of materials may be used such as ionomer resins, polyurethanes, balata and blends thereof.

The cover may be formed of a composition including very low modulus ionomers (VLMIs). As used herein, the term "very low modulus ionomers," or the acronym "VLMIs," are those ionomer resins further including a softening comonomer X, commonly a (meth)acrylate ester, present from about 10 weight percent to about 50 weight percent in the polymer. VLMIs are copolymers of an α-olefin, such as ethylene, a softening agent, such as n-butyl-acrylate or iso-butyl-acrylate, and an α,β-unsaturated carboxylic acid, such as acrylic or methacrylic acid, where at least part of the acid groups are neutralized by a magnesium cation. Other examples of softening comonomers include n-butyl methacrylate, methyl acrylate, and methyl methacrylate. Generally, a VLMI has a flexural modulus from about 2,000 psi to about 10,000 psi. VLMIs are sometimes referred to as "soft" ionomers.

Ionomers, such as acid-containing ethylene copolymer ionomers, include E/X/Y copolymers where E is ethylene, X is a softening comonomer such as acrylate or methacrylate present in 0 to 50 weight percent of the polymer, and Y is acrylic or methacrylic acid present in 5 to 35 (often 10 to 20) weight percent of the polymer, wherein the acid moiety is neutralized 1 to 90 percent (usually at least 40 percent) to form an ionomer by a cation such as lithium, sodium, potassium, magnesium, calcium, barium, lead, tin, zinc or aluminum, or a combination of such cations, lithium, sodium and zinc being the most preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

To aid in the processing of the cover stock, ionomer resins may be blended in order to obtain a cover having desired characteristics. For this reason, the cover may be formed from a blend of two or more ionomer resins. The blend may include, for example, a very soft material and a harder material. Ionomer resins with different melt flow indexes are often employed to obtain the desired characteristics of the cover stock. SURLYN® 8118, 7930 and 7940 have melt flow indices of about 1.4, 1.8, and 2.6 g/10 min., respectively. SURLYN® 8269 and SURLYN® 8265 each have a melt flow index of about 0.9 g/10 min. A blend of ionomer resins may be used to form a cover having a melt flow index, for example, of from about 1 to about 3 g/10 min. The cover layer may have a Shore D hardness, for example, ranging from about 60 to about 70.

The cover generally includes thermoplastic and/or thermoset materials. For example, the cover may include a thermoplastic material such as urethane or polyurethane. Polyurethane is a product of a reaction between a polyurethane prepolymer and a curing agent. The polyurethane prepolymer is a product formed by a reaction between a polyol and a diisocyanate. Often, a catalyst is employed to promote the reaction between the curing agent and the polyurethane prepolymer. In the case of cast polyurethanes, the curing agent is typically either a diamine or glycol.

As another example, a thermoset cast polyurethane may be used. Thermoset cast polyurethanes are generally prepared using a diisocyanate, such as 2,4-toluene diisocyanate (TDI), methylenebis-(4-cyclohexyl isocyanate) (HMDI), or paraphenylene diisocyanate ("PPDI") and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. Other suitable thermoset materials include, but are not limited to, thermoset urethane ionomers and thermoset urethane epoxies. Other examples of thermoset materials include polybutadiene, natural rubber, polyisoprene, styrene-butadiene, and styrene-propylene-diene rubber.

When the cover includes more than one layer, e.g., an inner cover layer and an outer cover layer, various constructions and materials are suitable. For example, an inner cover layer may surround the intermediate layer with an outer cover layer disposed thereon or an inner cover layer may surround a plurality of intermediate layers. When using an inner and outer cover layer construction, the outer cover layer material may be a thermoset material that includes at least one of a castable reactive liquid material and reaction products thereof, as described above, and may have a hardness from about 30 Shore D to about 60 Shore D.

The inner cover layer may be formed from a wide variety of hard (e.g., about 65 Shore D or greater), high flexural modulus resilient materials, which are compatible with the other materials used in the adjacent layers of the golf ball. The inner cover layer material may have a flexural modulus of about 65,000 psi or greater. Suitable inner cover layer materials include the hard, high flexural modulus ionomer resins and blends thereof, which may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 weight percent of the polymer, and Y is acrylic or methacrylic acid present in 5-35 weight percent of the polymer, wherein the acid moiety is neutralized about 1-90 percent to form an ionomer by a cation such as lithium, sodium, potassium, magnesium, calcium, barium, lead, tin, zinc, or aluminum, or a combination of such cations. Specific examples of acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof.

Manufacturing Process

One common technique for manufacturing golf balls is a laminate process. In order to form multiple layers around the center, a laminate is first formed. The laminate includes at least two layers and sometimes includes three layers. The laminate may be formed by mixing uncured core material to be used for each layer and calendar rolling the material into thin sheets. Alternatively, the laminate may be formed by mixing uncured intermediate layer material and rolling the material into sheets. The laminate sheets may be stacked together to form a laminate having three layers, using calender rolling mills. Alternatively, the sheets may be formed by extrusion.

A laminate also may be formed using an adhesive between each layer of material. For example, an epoxy resin may be used as adhesive. The adhesive should have good shear and tensile strength, for example, a tensile strength over about 1500 psi. The adhesive often has a Shore D hardness of less than about 60 when cured. The adhesive layer applied to the sheets should be very thin, e.g., less than about 0.004 inches thick.

Preferably, each laminate sheet is formed to a thickness that is slightly larger than the thickness of the layers in the finished golf ball. Each of these thicknesses can be varied, but all have a thickness of preferably less than about 0.1 inches. The sheets should have very uniform thicknesses.

The next step in the method is to form multiple layers around the center. This may be accomplished by placing two laminates between a top mold and a bottom mold. The laminates may be formed to the cavities in the mold halves. The laminates then may be cut into patterns that, when joined, form a laminated layer around the center. For example, the laminates may be cut into figure 8-shaped or barbell-like patterns, similar to a baseball or a tennis ball cover. Other patterns may be used, such as curved triangles, hemispherical cups, ovals, or other patterns that may be joined together to form a laminated layer around the center. The patterns may then be placed between molds and formed to the cavities in the mold halves. A vacuum source often is used to form the laminates to the mold cavities so that uniformity in layer thickness is maintained.

After the laminates have been formed to the cavities, the centers are then inserted between the laminates. The laminates are then compression molded about the center under conditions of temperature and pressure that are well known in the art. The mold halves usually have vents to allow flowing of excess layer material from the laminates during the compression molding process. As an alternative to compression molding, the core and/or intermediate layer(s) may be formed by injection molding or other suitable technique.

The next step involves forming a cover around the golf ball core. The core, including center and intermediate layers, may be supported within a pair of cover mold-halves by a plurality of retractable pins. The retractable pins may be actuated by conventional means known to those of ordinary skill in the art.

After the mold halves are closed together with the pins supporting the core, the cover material is injected into the mold in a liquid state through a plurality of injection ports or gates, such as edge gates or sub-gates. With edge gates, the resultant golf balls are all interconnected and may be removed from the mold halves together in a large matrix. Sub-gating automatically separates the mold runner from the golf balls during the ejection of the golf balls from mold halves.

The retractable pins may be retracted after a predetermined amount of cover material has been injected into the mold halves to substantially surround the core. The liquid cover material is allowed to flow and substantially fill the cavity between the core and the mold halves, while maintaining concentricity between the core and the mold halves. The cover material is then allowed to solidify around the core, and the golf balls are ejected from the mold halves and subjected to finishing processes, including topcoating, painting, and/or other finishing processes, including processes in accordance with examples of this invention, as will be described in more detail below.

B. General Description of Coating Materials

A variety of materials may be used to form the topcoat, non-limiting examples of which include thermoplastics, thermoplastic elastomers such as polyurethanes, polyesters, acrylics, low acid thermoplastic ionomers, e.g., containing up to about 15% acid, and UV curable systems. The thickness of the topcoat typically ranges from of about 5 to about 25 μm, in some examples, from about 10 to about 15 μm.

Additional additives optionally may be incorporated into the coating material, such as flow additives, mar/slip additives, adhesion promoters, thickeners, gloss reducers, flexibilizers, cross-linking additives, isocyanates or other agents for toughening or creating scratch resistance, optical brighteners, UV absorbers, and the like. The amount of such additives usually ranges from 0 to about 5 wt %, often from 0 to about 1.5 wt %.

C. General Description of Coating Devices

The coating materials may be delivered by spray guns (either fixed or articulating types). Examples of devices that may be used include heated spray equipment and electrostatic and high volume-low pressure (HVLP) devices. The golf balls are typically placed on work holders, where they rotate and pass through a spray zone in a specified time to obtain full coverage of their exterior surfaces.

In some aspects, a carrier fluid comprising nitrogen gas or nitrogen-enriched air is used to deliver the coating material to the exterior surface of the golf ball. Nitrogen is clean, dry (anhydrous) in its elemental gas state. Nitrogen can be ionized to eliminate problems associated with moisture and static electricity.

Suitable equipment for applying coatings using nitrogen-enriched air is described, for example, in U.S. Pat. No. 6,821,315, the disclosure of which is incorporate by reference in its entirety. Such devices are commercially available from N2 Spray Solutions. In general, such devices operate by mixing a carrier fluid under pressure and the coating material. The carrier fluid comprises nitrogen-enriched air, which typically contains about 90-99.5% nitrogen by volume. Nitrogen-enriched air may be produced, for example, by passing air through hollow-fiber membranes as described in the '315 patent.

The temperature of the carrier fluid may be adjusted to optimize coating properties. In general, heating the carrier fluid reduces viscosity and reduces the need for solvents. Reducing viscosity improves flow, aides in atomization, and purges the solvent, resulting in a finer spray with a higher solids content. The carrier fluid may be heated, for example, to a temperature of about 100 to about 170° F. (38 to 76.6° C.), often from about 150 to about 170° F. (65.6 to 76.6° C.). Other parameters, such as pressure, also may be suitably adjusted to achieve improved drying characteristics and/or other efficiencies. For example, atomization air pressure of about 40 psi (275.8 kPa) may be employed.

The benefits of reducing the amount of solvent used include easier spraying, accelerated flash off and evaporation times, and reduced overspray. This in turn reduces waste of coating material, and provides a cleaner working environment with reduced static electricity, resulting in fewer airborne contaminants.

The nitrogen-enriched air delivery also may reduce application time, increase transfer efficiency, reduce dry times (especially for water-borne materials), reduce material usage (e.g., about 20% reduction in coating material used), increase flash times, change polarity to promote attraction of the coating to the ball surface, reduce filter usage, remove surface moisture, remove solid impurities, eliminate variability of density in air, eliminate solvent pop, eliminate major uncontrollable variables, and reduce VOC emissions. The nitrogen-enriched air delivery system also may beneficially return pure oxygen back to the environment. The carrier fluid may be ionized to eliminate problems associated with moisture and static electricity.

Other benefits relative to compressed air delivery include reduced coating thickness, less variance in the coating thickness and average thickness, less pooling in dimples, edge ratio closer to the idea value of 1.0, faster cure times, reduced material flow rate, and reduced atomization air pressure. For example, the material flow rate may be reduced from about 50 to about 40 cc/min (20% percent reduction). Atomization air pressure may reduced from about 50 to about 40 psi (344.8 to 275.8 kPa) (20% reduction). Drying time for the coating may be reduced about 30%, which can reduce the overall coating drying time from a full shift (e.g., about 8-10 hours) to considerably less (e.g., 5-7 hours), which reduces oven time, heating time, overall throughput time, etc., and the associated expenses. The faster drying times also may contribute to the reduced dimple bottom pooling effect as described above.

Another potential benefit is that the reduction in coating thickness may allow for increases in weights (and potentially more select placement of weight) in other desired locations of the ball, such as in the core, the mantle, cover, and/or other layers to improve performance characteristics or achieve other benefits.

D. Specific Examples of Invention

Figure 2:
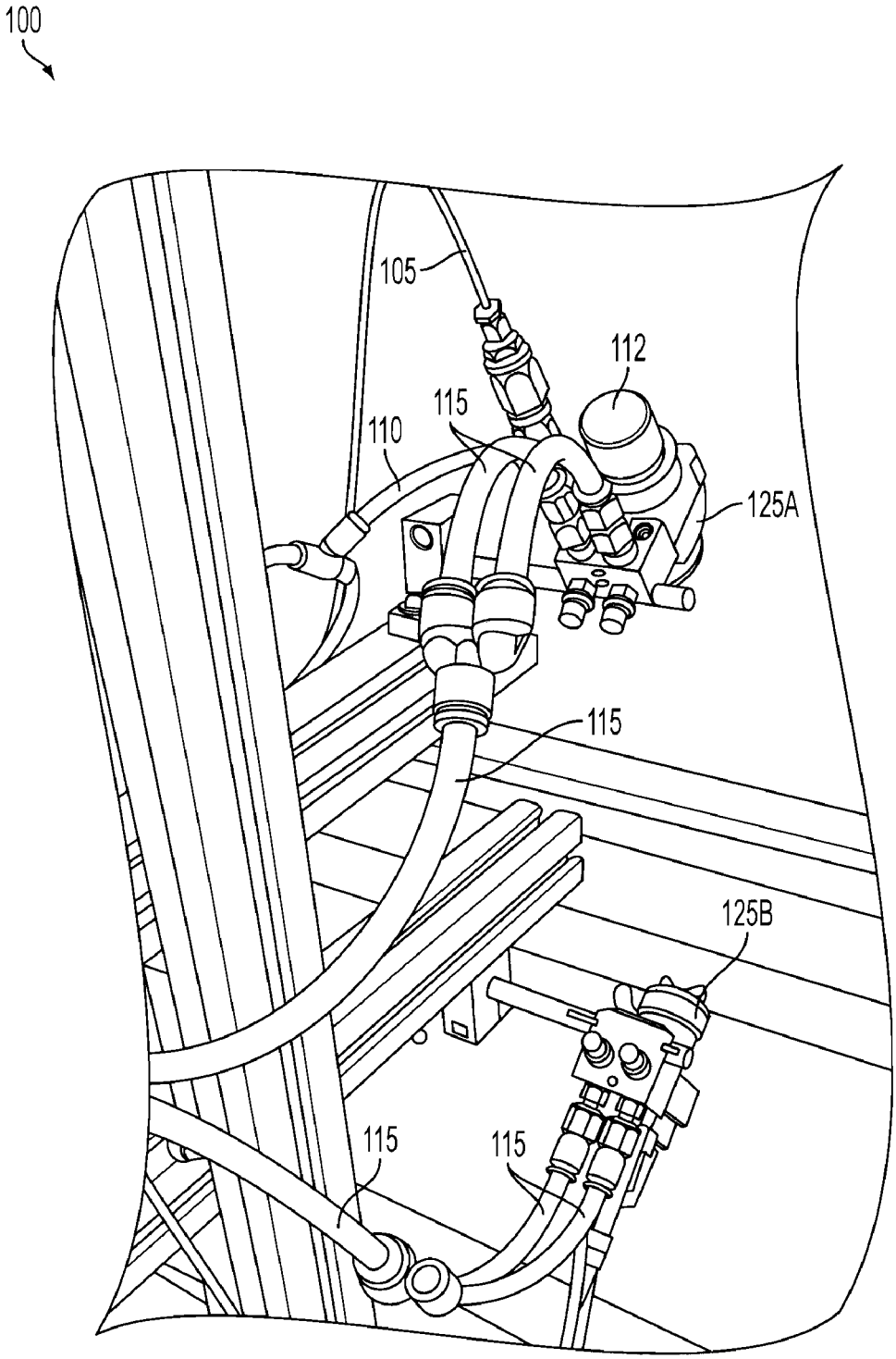
FIGS. 2 and 2A illustrate a coating apparatus that may be used for applying a topcoat to golf balls using nitrogen-enriched air delivery.
Figure 2A:
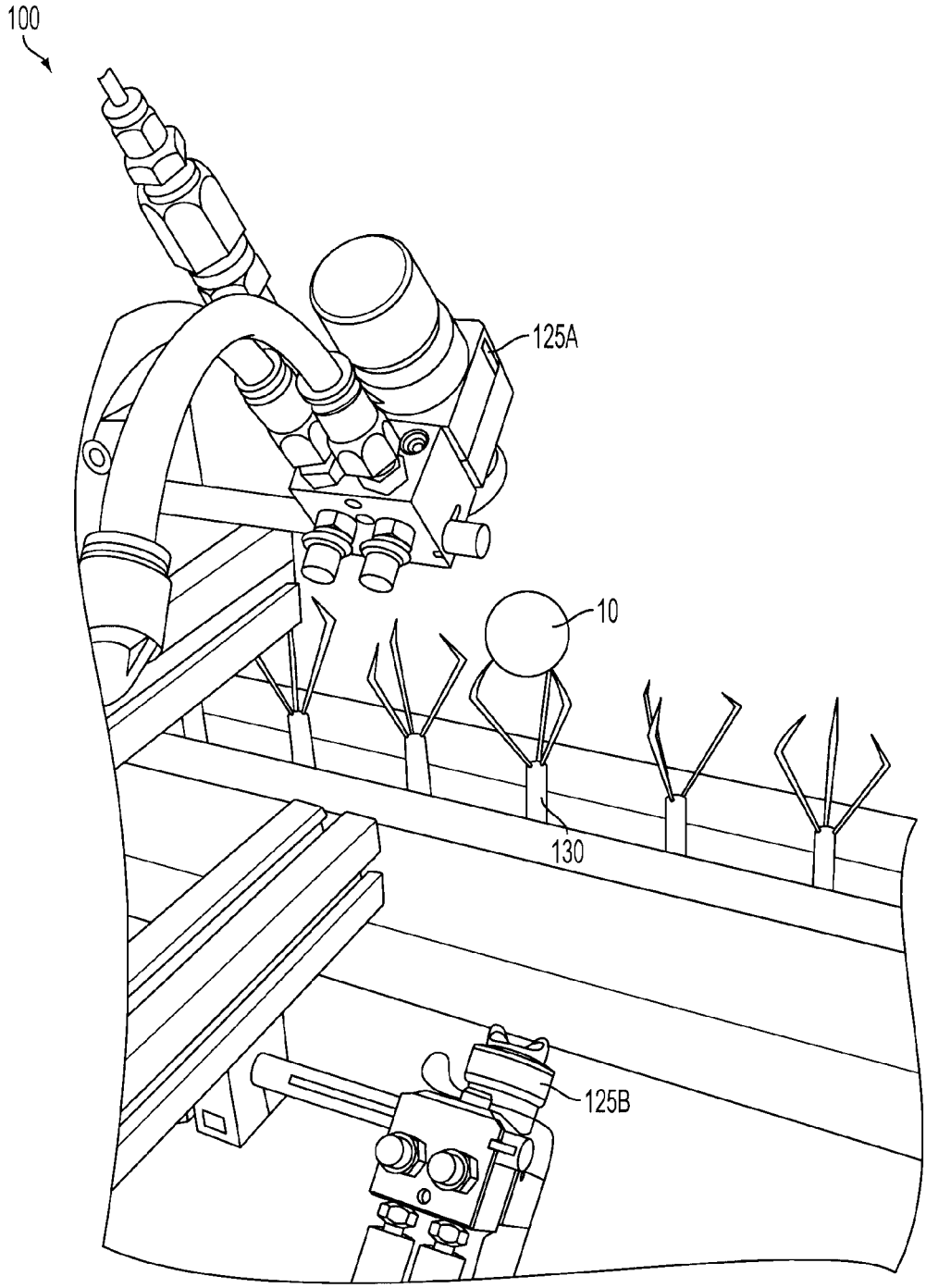

With reference to FIGS. 2 and 2A, a coating apparatus 100 is shown that may be used for applying the topcoat 20. The device 100 shown has an upper spray head 125A and a lower spray head 125B. The coating material is supplied to the spray heads 125A and 125B via inlet line 105. A coating material inlet valve, such as a solenoid valve 112, and a valve actuation control line 110 control the flow of coating material from the inlet line 105 through the spray nozzles included in the spray heads. Heated nitrogen-enriched air is supplied via lines 115 to the upper 125A and lower spray heads 125B. As shown in FIG. 2A, the golf balls 10 may be placed on a rotating ball holder 130, which helps to provide an even coating layer over the entire exterior surface of the balls.

FIGS. 2 and 2A illustrate an arrangement utilizing two fixed spray heads 125A and 125B. In some examples, three or more fixed spray heads may be used. Alternatively, one or more spray heads may be mounted on a movable, articulatable mount (not illustrated) that moves as the balls move through the spray chamber. Such movement may be programmed to better apply a uniform coating over the exterior ball surface.

EXAMPLES

Twelve golf balls were evaluated to compare coatings applied using conventional compressed air delivery to coatings applied using nitrogen-enriched air delivery. Golf balls 1-6 had solvent-based polyurethane topcoats applied using conventional compressed air delivery. Golf balls 7-12 had solvent-based polyurethane topcoats applied using nitrogen-enriched air delivery as described herein.

Three sample areas from each ball, one dimple at the top, one at the middle, and one at the bottom were taken for measurement. From each sample area, seven spots were analyzed.

Three samples of each golf ball were cut out, one each from the top, the middle and the bottom. From each sample the biggest dimple was taken to compare it to another dimple. Each sample was analyzed on both sides of the dimple at the fret, edge, slope and in the center. These portions are shown, for example, in FIG. 3. The fret refers to the area between dimples; the edge is the intersection between the fret and the curved slope of the dimple; and the center refers to the dimple bottom.

Figure 3:
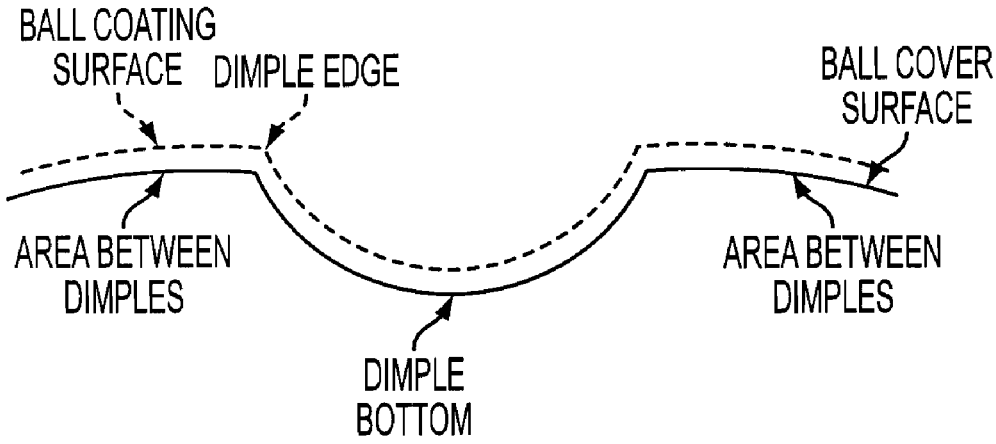
FIGS. 3 and 3A illustrate topcoat thickness distribution across a dimple pattern on a micro level.
Figure 3A:
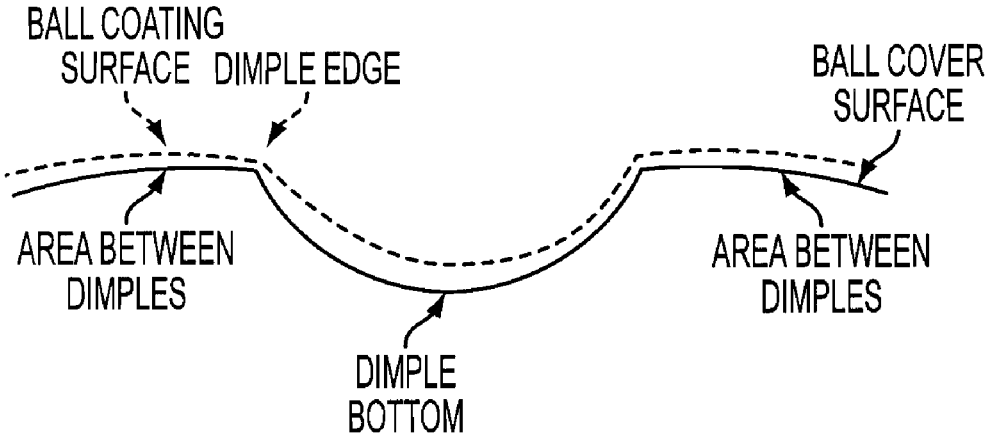
FIG. 3A PRIOR ART

With reference to FIGS. 3 and 3A, it is desirable for the coating to have a constant thickness over the surface. FIG. 3 illustrates a coating having a thickness at the dimple edge that is the same as the coating thickness at the dimple bottom, resulting in an edge ratio of 1.0 ($T_{edge}/T_{bottom}=1.0$). Edge ratios close to 1.0 are indicative of uniform thicknesses. Edge ratio is calculated by dividing the average coating thickness at the edge of the dimple by the average coating thickness at the bottom middle of the dimple. As shown in FIG. 3A, in the practice of conventional coating methods such as compressed air delivery, the coating tends to run down the dimple edges and "pool up" in the dimple bottom. This results in a non-uniform coating, such that the edge ratio $T_{edge}/T_{bottom}$ may differ significantly from 1, in some cases being about 0.5 or even lower.

The compressed air delivery gives the golf ball a thicker coating in a dimple (see FIG. 3A) than the method with the nitrogen-enriched air delivery (see FIG. 3). The compressed air samples had an average thickness of 14.24 μm and a standard deviation of about 3 μm. The nitrogen-enriched air delivery samples had an average thickness of 12.2 μm and a standard deviation of about 3.3-2.4 μm.

Figure 4:
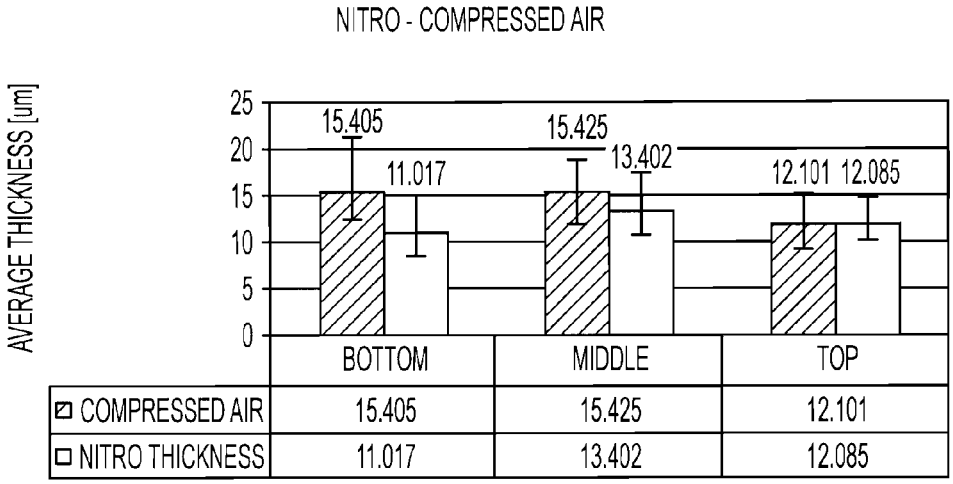
FIG. 4 shows the average coating thickness (bottom, middle, and top) of golf balls for coatings applied using nitrogen-enriched and using air compressed air delivery.
Figure 5:
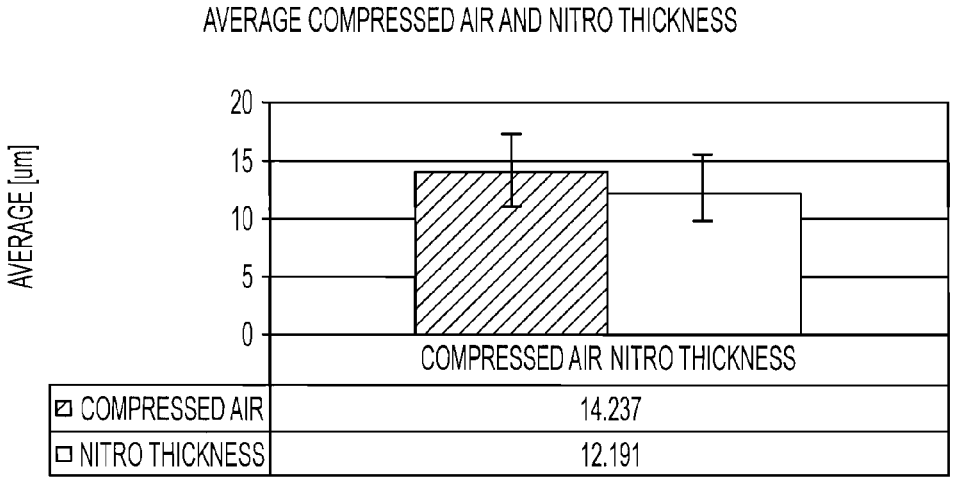
FIG. 5 shows overall golf ball coating thickness, comparing compressed air delivery and nitrogen-enriched air delivery.

FIG. 4 shows average coating thickness for measurements taken at the bottom, middle, and top of the golf balls. FIG. 5 shows overall thicknesses of the coatings prepared by compressed air and nitrogen-enriched air delivery. The thin vertical bars represent standard deviation. As can be seen from FIGS. 4 and 5, nitrogen-enriched air delivery resulted in reduced overall coating thickness, and less variability in thicknesses between the bottom, middle, and top portions as compared to compressed air delivery.

Figure 6:
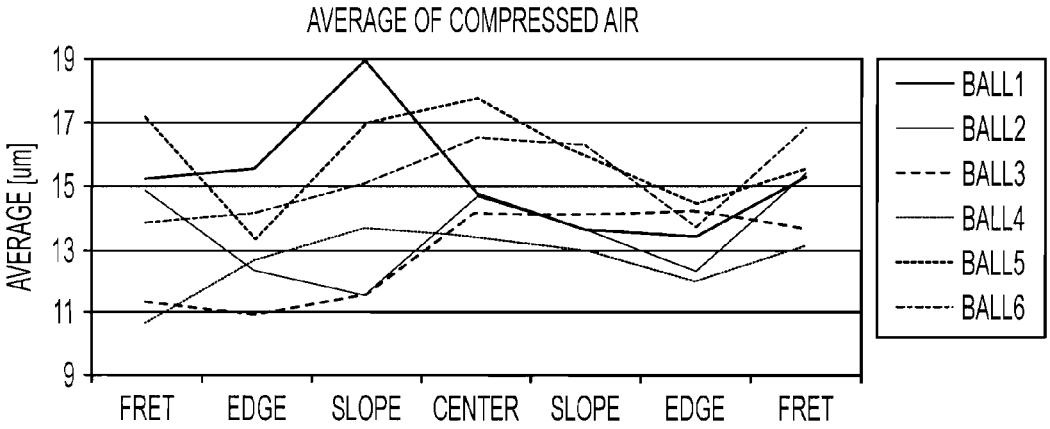
FIG. 6 illustrates the variability measured in dimple locations (fret, edge, slope, center, slope, edge and fret) for coatings applied using compressed air delivery.
Figure 7:
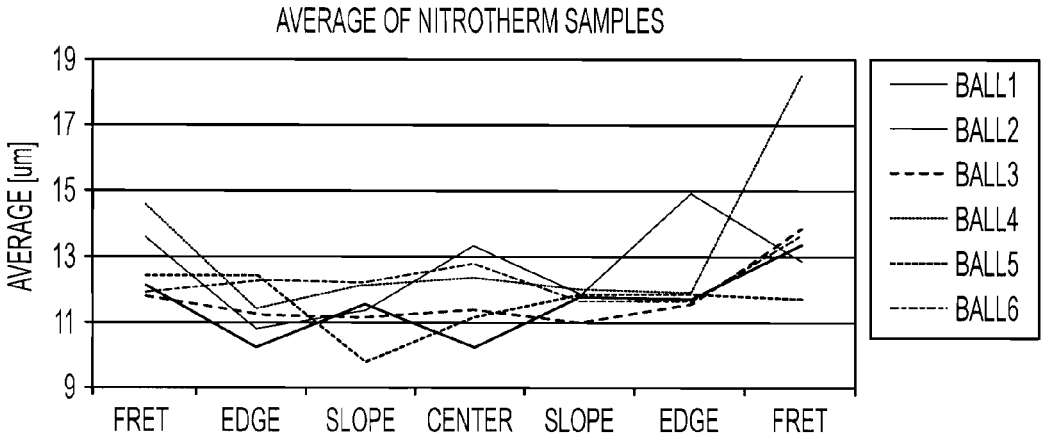
FIG. 7 illustrates the variability measured in dimple locations (fret, edge, slope, center, slope, edge and fret) for coatings applied using nitrogen-enriched air delivery.

FIG. 6 compares each measured spot (fret, edge, slope, center, slope, edge and fret) in the dimple for the golf balls that were coated using compressed air delivery. FIG. 7 shows the same measurements for the golf balls that were coated using nitrogen-enriched air delivery. It can be seen that the coatings applied with nitrogen-enriched air delivery (FIG. 7) were generally thinner at each measured spot, and there was less variability in thicknesses from spot to spot as compared to coatings applied using compressed air delivery (FIG. 6).

Figure 8:
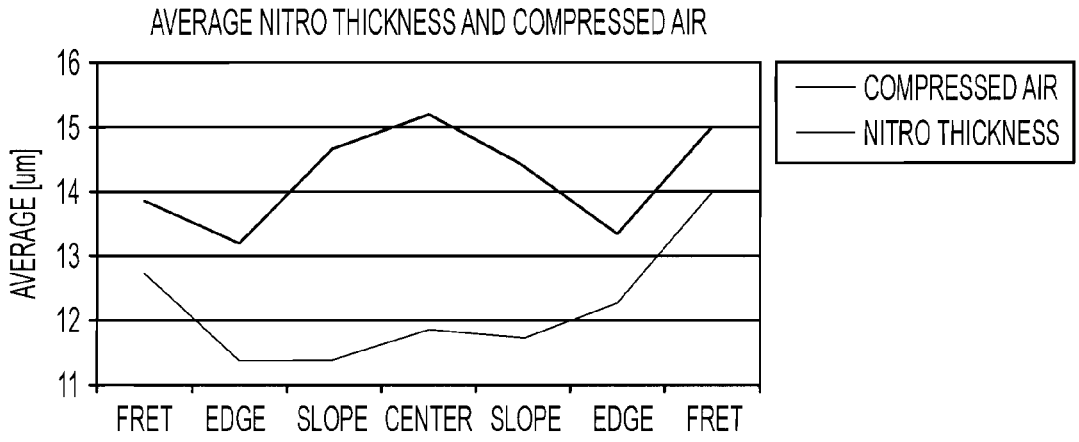
FIG. 8 compares the average thicknesses of the measurements illustrated in FIGS. 6 and 7.

The average thickness measurements shown in this data from each measured spot (FIGS. 6 and 7) are compared in FIG. 8. The highest peak of the compressed air sample is in the center and is also going up at the fret, whereas the samples prepared by nitrogen-enriched air delivery exhibited their highest peak at the fret. This characteristic was found to advantageously influence ball trajectory and increase distance.

Figure 9:
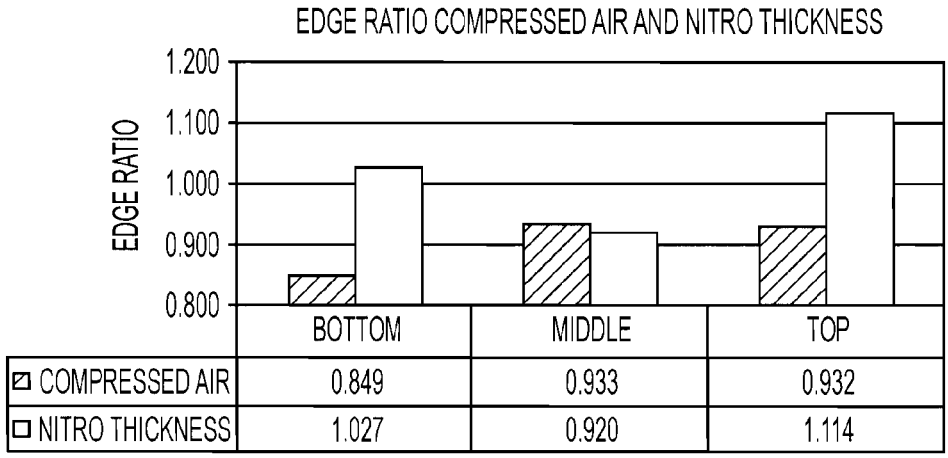
FIG. 9 illustrates the edge ratios (bottom, middle, top) for coatings applied using compressed air delivery and nitrogen-enriched air delivery.
Figure 10:
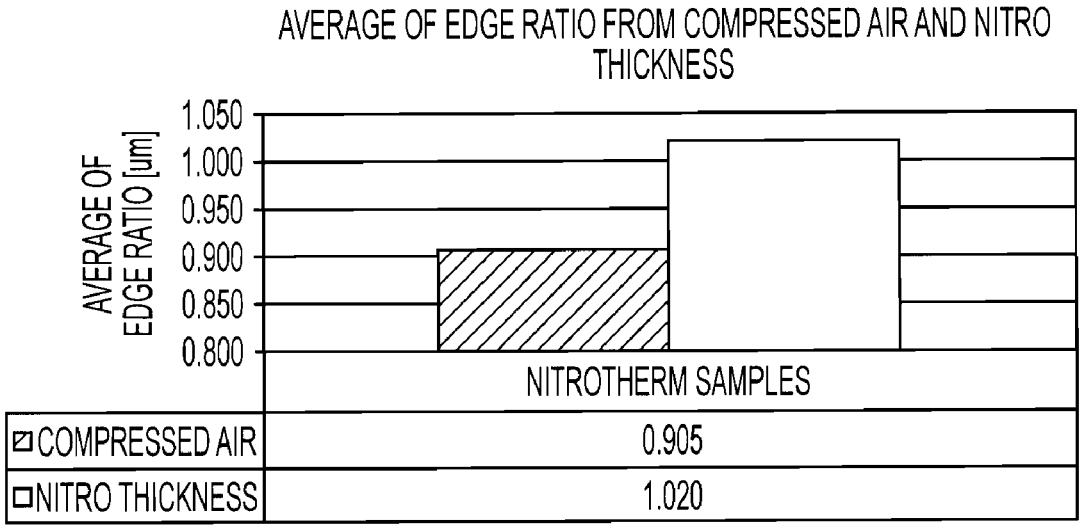
FIG. 10 illustrates the average edge ratios of the coatings reported in FIG. 9.

FIG. 9 shows the edge ratio from six balls for the bottom, middle and top for the compressed air samples and the nitrogen-enriched air samples. FIG. 10 shows the average of each edge ratio for the compressed air and nitrogen-enriched air samples. The compressed air samples had an average edge ratio of about 0.9, whereas the nitrogen-enriched air samples had an average edge ratio of about 1.0.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A method of applying a polyurethane topcoat to a surface of a golf ball having dimples comprising:

combining a polyurethane coating material and a carrier fluid of nitrogen or nitrogen-enriched air to form a mixture; and applying the mixture onto the surface of the golf ball;

wherein the thickness of the coating on the exterior surface of the golf ball is from about 10 to about 15 μm; and wherein an average edge ratio of the topcoat is about 1.0.

2. The method of claim 1 wherein the carrier fluid comprises air enriched to about 90-99.5% nitrogen by volume.

3. The method of claim 1 further comprising heating the mixture to a temperature of from about 100 to about 170° F. (38 to 76.6° C.).

4. The method of claim 3 wherein the temperature is from about 150 to about 170° F. (65.6 to 76.6° C.).

5. The method of claim 1 wherein the coating material is a thermoplastic polymer.

6. The method of claim 5 wherein the coating material is a polyurethane.

7. The method of claim 1 wherein the nitrogen-enriched air is produced by passing air through a hollow-fiber membrane.

8. The method of claim 1 further comprising ionizing the nitrogen-enriched air.

9. The method of claim 1 wherein the coating material and carrier fluid are pre-mixed and the mixture is sprayed through one or more spray nozzles.

10. The method of claim 1 wherein the coating material is sprayed through one or more first nozzles, and the carrier fluid is sprayed through one or more second nozzles to form the mixture.

11. A method of applying a polyurethane topcoat to an exterior surface of a golf ball having dimples comprising:

combining a polyurethane coating material and a carrier fluid containing air enriched to about 90-99.5% nitrogen by volume to form a mixture;

heating the mixture to a temperature of from about 100 to about 170° F. (38 to 76.6° C.); and spraying the mixture onto the exterior surface of the golf ball to form a coating having a thickness from about 10 to about 15 μm;

wherein an average edge ratio of the topcoat is about 1.0.

12. The method of claim 11 wherein the temperature is from about 150 to about 170° F. (65.6 to 76.6° C.).

13. The method of claim 11 wherein the nitrogen-enriched air is produced by passing air through a hollow-fiber membrane.

14. The method of claim 11 further comprising ionizing the nitrogen-enriched air.

* * * * *